United States Patent [19]

Bykov et al.

[11] 4,115,043

[45] Sep. 19, 1978

[54] SUCTION VALVE OF THE PISTON COMPRESSOR

[76] Inventors: Alexandr Vasilievich Bykov, ulitsa Vavilova, 52, korpus 4, kv. 324; Igor Martynovich Kalnin, ulitsa Kropotkinskaya, 26, kv. 13; Vsevolod Sergeevich Scherbakov, ulitsa Vvedenskogo, 24, kv. 120; Igor Andreevich Gruzintsev, Malaya Schukinskaya ulitsa, 5, korpus 2, kv. 14, all of Moscow, U.S.S.R.

[21] Appl. No.: 744,760

[22] Filed: Nov. 24, 1976

[30] Foreign Application Priority Data

Dec. 2, 1975 [SU] U.S.S.R. ..... 2195813

[51] Int. Cl.$^2$ ..... F04B 21/02

[52] U.S. Cl. ..... 417/559

[58] Field of Search ..... 417/559, 562; 137/514

[56] References Cited

U.S. PATENT DOCUMENTS

| | | | |
|---|---|---|---|
| 1,768,638 | 7/1930 | Shenks | 137/514 |
| 2,908,287 | 10/1959 | Augustin | 137/856 |
| 3,369,563 | 2/1968 | Domingor | 137/514 |
| 3,416,724 | 12/1968 | Lenkel | 417/559 |
| 3,792,718 | 2/1974 | Kohler | 137/514 |

FOREIGN PATENT DOCUMENTS

| | | | |
|---|---|---|---|
| 180,287 | 4/1966 | U.S.S.R. | 417/559 |
| 383,874 | 11/1973 | U.S.S.R. | 417/559 |
| 401,822 | 2/1974 | U.S.S.R. | 417/559 |

*Primary Examiner*—William L. Freeh

*Attorney, Agent, or Firm*—Robert E. Burns; Emmanuel J. Lobato; Bruce L. Adams

[57] ABSTRACT

A suction valve, preferably with a plate closing member, is made without any mechanical spring members and comprises a plate travel damper in the form of freely movable valve plate arranged on one or both sides of a pressure accumulating chambers having metering orifices through which flows gas under a mean pressure towards the closing orifice, a gas cushion is created to damp the travel of the plate.

6 Claims, 5 Drawing Figures

SUCTION VALVE OF THE PISTON COMPRESSOR

BACKGROUND OF THE INVENTION

The present invention relates to compressors, and more particularly to a structure of suction valves of piston cooling compressors.

Known in the prior art are structures of self-acting suction valves for use in a compressor, comprising a seat, a lift stop, a valve plate and a spring accommodated between the plate and the lift stop (Cf. M. N. Frenkel, "PISTON COMPRESSORS", Leningrad Publishing House, 1969, p.p. 329 to 355; COOLING EQUIPMENT, Encyclopaedic Reference Book, vol.I, Publishers GOSTORGIZDAT, 1960, p.p. 212 to 214).

Prior art structures of suction valves, comprising a seat and a lift stop with a valve plate being arranged in the interspace therebetween are also known (cf. USSR Inventor's Certificates No.225,370 and No.479,396, Cl. F 04 b 49/00).

However, the prior art suction valves do not provide for a long service life and higher efficiency of the compressor since the valves are fitted with resilient members (springs) to ensure the closing of valves at the end of the suction stroke. For example, for closing the ring valves use is made of coil springs accommodated in the slots of the lift stop, whereas the plate valves whose plates are usually made of special steel, are closed at the expense of elasticity of the springs.

Thus, all the known structures of the self-acting suction valves of the compressor are closed under the effect of the valve resilient members (springs, elastic properties of plates). However, the use of resilient members in the valves substantially impairs reliability and reduces the service life thereof, determined, in this case by the rate of wear fatigue of metal and, depending on the rotation speed of the compressor, ranges within several thousands of hours. This is a very serious disadvantage which lies in that the speed of compressors is kept down within the range of from 1,000 to 1,500 r.p.m.

SUMMARY OF THE INVENTION

It is an object of the present invention to eliminate the above-mentioned disadvantages and enhance the efficiency and service life of valves for high-speed compressors (3,000 to 4,000 r.p.m.)

It is another object of the invention to provide a suction valve for a piston compressor with enhanced service life and improved reliability.

It is still another object of the invention to provide a suction valve for a piston compressor which ensures higher efficiency of the piston compressor particularly due to the reduction of restriction losses in the valve.

It is likewise an object of the invention to provide a suction valve for a piston compressor to be successfully used on a high-speed gas, and air compressors of average and high capacity, with a rotation speed of up to 3,000 to 4,000 r.p.m.

It is still another object of the present invention to provide a modified suction valve for a piston compressor which is inexpensive to manufacture and easy to operate.

These and other objects of the invention are attained in a suction valve installed in the circuit between a variable-pressure chamber and a chamber containing a closing movable member arranged between the valve seat and the closing member travel stop. The valve is characterized in that the closing member is installed for free movement and there is provided a pneumatic damper for moving the closing member, comprising at least one pressure accumulating chamber communicating with the variable-pressure chamber adapted to sustain a pressure of mean value and having a metering orifice opened to said closing member and intended for damping its travel towards the pressure accumulating chamber.

Such a structural arrangement enables substantial reduction of restriction losses in the herein proposed valve during the suction stroke and enhance the cylinder admission ratio. (The proposed valve does not comprise elastic spring members which cause additional restriction losses).

According to another embodiment of the invention, there is proposed a suction valve characterized in that a pneumatic damper for moving a closing member comprises a plurality of pressure accumulating chambers dispositioned on opposite sides of the closing member thereby to damp its movements in both directions.

Still another embodiment of the present invention discloses a suction valve characterized in that pressure accumulating chambers are formed directly in the valve seat and in the travel stop the chambers having metering orifices opened directly into the surface of the closing member such that gas cushion is created as the closing member approaches the metering orifice.

Improvements thus for proposed hereinabove provide for the timely valve closing that is, its setting on to the seat at the bottom dead point thereof, thereby avoiding the impact load created when the valve is shut off with a reverse flow of working gas.

Owing to the absence of resilient members (springs), the herein proposed valve pneumatic control system permits increase of the valve service life by 4–6 times and application of these types of valves on high-speed compressors with a rotation speed thereof ranging from 3,000 to 4,000 r.p.m.

Still another embodiment of the present invention is characterized in that the diameters of the pressure accumulating chambers and their metering orifices are selected such that an average flow rate of gas passing from the pressure accumulating chambers ensure a prescribed damping force induced during the movement of the closing member.

According to still another embodiment of the present invention, there is proposed a suction valve for a piston compressor comprising an annular plate closing member and characterized in that the annular plate member freely rests during the delivery cycle on an annular valve seat, the closing member having its surface on the other side thereof along the periphery of the annular travel stop formed with pressure accumulating chambers for movement of the control damper.

Finally, according to still another embodiment of the invention there is proposed a suction valve for a piston compressor, which features a plurality of seats arranged in parallel and separated by a movable closing plate, characterized in that the ends of said plate are hinged at one side, whereas at the other side thereof, unfixed ends arranged in the parallel seats are formed with pressure-accumulating chambers having their metering orifices in the form of the holes of the seats opened in both directions to the adjacent closing plates.

BRIEF DESCRIPTION OF THE DRAWINGS

These and other advantages of the present invention will become more apparent from the following description of preferred embodiments thereof with due reference to the accompanying drawings.

In the drawings.

DESCRIPTION OF THE PREFERRED EMBODIMENTS

Figure 1:
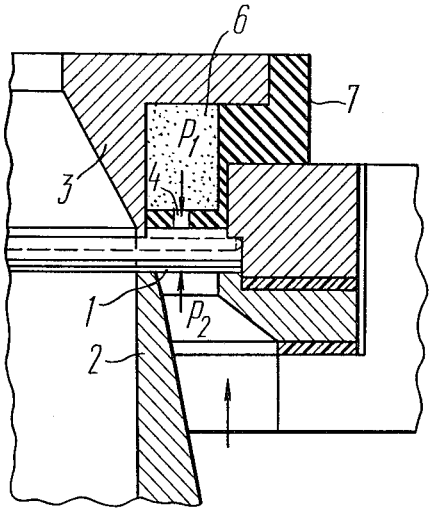
FIG. 1 is a sectional view of a ring suction valve, according to the invention.

Referring now to the drawings, the structure and operation of the invention is disclosed. A suction valve for a piston compressor according to the invention comprises a valve plate 1 arranged or located in an interspace between a valve seat 2 and a lift stop 3. The plate 1 is a floating valve plate and is installed for free movement and is not loaded by any stress. The valve seat 2 and the lift stop 3 are formed with metering orifices 4 and 5 disposed above the upper and lower (right-hand and left-hand) planes of the plate, respectively and communicating with a chamber 6 having a mean indicated pressure $P_1$.

The disposion of the metering orifices 4 and 5 may vary with the valve structure.

The herein proposed suction valve shown in FIG. 1 has metering orifices 4 formed in the lift stop 3 above the valve plate 1, communicating the mean indicated pressure chamber 6, formed in the interior of the body of a valve 7, with an interspace between the lift stop 3 and the valve plate 1.

Figure 2:
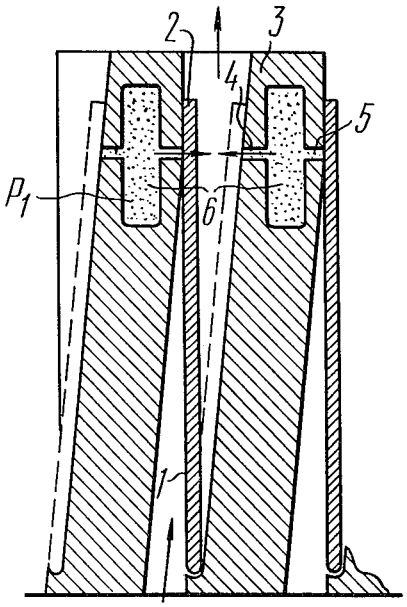
FIG. 2 is a sectional view of a straight-way valve, according to the invention.

A straight-way valve shown in has its metering orifices 4, FIG. 2, and 5 formed in a lift stop 3 and are brought into communication with mean indicated pressure chamber 6 from both sides.

Figure 3A:
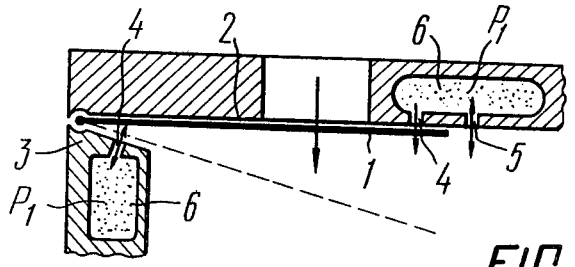
FIG. 3*a* is a sectional view of a plate suction valve, according to the invention.
Figure 3B:
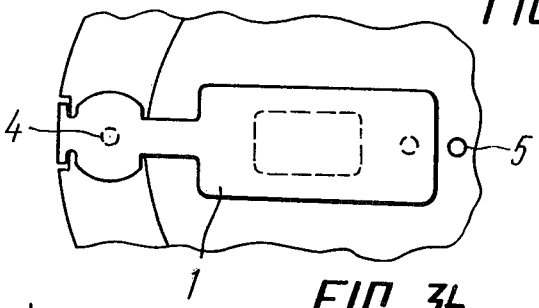
FIG. 3*b* is a top plan view of the plate suction valve in FIG. 3*a*.

In a plate valve shown in FIG. 3, metering orifices 4 and 5 are formed in a valve seat 2 and in a lift stop 3 at both sides of the valve plate.

Figure 4:
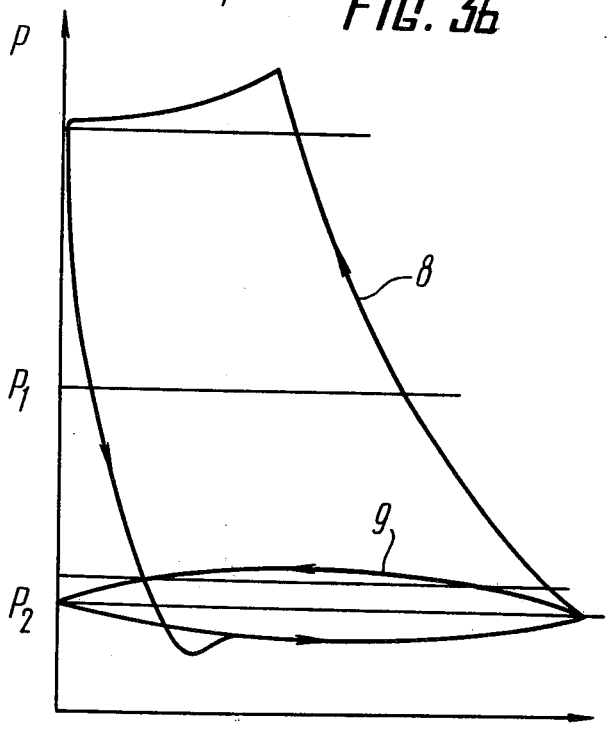
FIG. 4 shows indicated pressure diagrams in the compressor cylinder chamber during normal operation of the compressor and at discharging cycle thereof.

FIG. 4 shows indicated pressure diagrams in the cylinder chamber of a compressor during its normal operation (see curve 8) and during discharge (see curve 9) of the compressor, for example, by way of electromagnetic pressing-out of the ring valve plate (see FIG. 1). During normal operation of the compressor, mean indicated pressure $P_1$ is established in the chamber 6 communicating via metering orifices 4 and 5 with the cylinder chamber. This pressure is maintained within a given range due to the inlet flow of gas passing through the metering orifices at the compression stroke and due to the gas outlet flow passing through same at the admission stroke.

In the ring suction valve shown in FIG. 1 the same metering orifices 4 are used for closing the valve as well as for maintaining mean indicated pressure $P_1$ in the chamber 6.

In the straight-way valve shown in FIG. 2, the shifting of the valve plates 1 from one position to another (closed-open position) is effected by means of oppositely disposed metering orifices 4 and 5. The plates 1 are fixed by a ring not shown but have their free end portion deflectable to the positions shown.

In the embodiment of the plate valve (FIG. 3) the mean indicated pressure chamber 6, with pressure *p*, disposed over the valve has two throttling orifices 4 and 5. The orifice 4 serves to open the valve and the orifice 5 for maintaining a mean indicated pressure *p*, in the chamber 6 because during the compression stroke the orifice 4 is closed by the plate of the valve. In this instance the valve is closed by a jet from the chamber 6 disposed under the plate in the valve travel stop 3.

The embodiments of the herein proposed invention are based on the same operating principle, viz., during admission cycles the pressure in the cylinder goes down to be lower than $P_2$ (see FIG. 4). As a result, gas under pressure on the order of $P_1$ mean indicated pressure) flows from the metering orifices 4 and 5 (11 and 12) to create a gas cushion above the surface of the valve plate, which, tending to expand, urges the valve into the opposite position. With the provision of metering orifices on both sides, of the plate (in the seat of a lift stop see FIGS. 2 and 3), the valve plate is automatically shifted from the closed position into the "open position" and vice versa, at the beginning and at the end of the admission stroke, respectively.

In some cases, for example as shown in FIG. 1, the valve is opened by admission stream which uplifts the annular valve plate 1, said valve being closed by means of gas cushion created above the plate 1 due to the inflow of gas passing through the metering orifices 4. It is quite possible to open and close the valve at prescribed points of the indicated pressure diagram by selecting corresponding parameters of the valve.

The valve control system described above permits substantial reduction of restriction losses in the proposed valve at the admission stroke, as weel as an increase of the cylinder admission ratio. The valve of the invention features the absence of resilient members (springs) which cause additional restriction losses.

The valve control system also enables timely closing of the valve (that is its setting on to the seat) at the bottom dead point, avoiding the compact load when the valve is shut off with reversed jet of the working gas.

Owing to the absence of resilient members (springs) the proposed valve pneumatic control system ensures longer service life, increased by 4–6 times, permitting the application of these valves on high-speed compressors with a speed thereof ranging from 3,000 to 4,000 r.p.m.

What is claimed is:

1. A suction valve for use in a piston compressor for compressing a gaseous fluid comprising, a valve body member defining at least one mean pressure accumulating chamber disposed in use in communication with the interior of a compressor cylinder thereby to be in communication with the effect of suction and pressure strokes of a piston in the compressor cylinder, said valve body member defining at least one admission chamber separate from the mean pressure accumulating chamber and communicable in use with a gaseous fluid to be compressed in said cylinder, said body valve member defining a space defined between said mean pressure accumulating chamber and said admission chamber, said mean pressure accumulating chamber and said admission chamber each having a metering orifice in communication with the interior of the corresponding chamber and with said space, a valve plate in said space having at least a portion freely movable under control solely of the gaseous fluid pressure in said accumulating chamber and of itself for moving from a seated position closing the metering orifice to said admission chamber to an unseated position opening the last-mentioned metering orifice to establish communication between the admission chamber and said mean pressure accumulating chamber through said space, means defining a seat in said valve body member on which said valve plate is seated in said space and means for defining a stop in said valve body member for stopping and limiting the movement of said valve plate in opening the metering orifice to said admission chamber.

2. A suction valve for use in a piston compressor for compressing a gaseous fluid according to claim 1, in which said valve plate is a plate freely movable in said space and is normally seated under control of its own mass under the effect of gravity and is lifted off said seat during a suction period in said cylinder.

3. A suction valve for use in a piston compressor for compressing a gaseous fluid according to claim 1, in which said valve plate is deflectable and is secured pivotally at one end with said portion thereof free to be deflected and unseated under the control of a suction pressure developed in said cylinder and said mean pressure accumulating chamber and restored to a seated position when a given pressure exists in said mean pressure accumulating chamber.

4. A suction valve for use in a piston compressor for compressing a gaseous fluid according to claim 1, in which said valve body member comprises a plurality of accumulating chambers and a plurality of admission chambers each having metering orifices in communication with said space, and said valve plate being freely movable in said space and configured to close the metering orifices of the admission chambers under control of its own weight biased by gravity and to lift off said seat and open the last-mentioned orifices under the control of a suction pressure developed in said means pressure accumulating chambers.

5. A suction valve for use in a piston compressor for compressing a gaseous fluid according to claim 1, in which said valve body member comprises a plurality of mean pressure accumulating chambers and a plurality of admission chambers each having a metering orifice, said valve body member having a plurality of spaces in communication with metering orifices of corresponding mean pressure accumulating chambers and admission chambers, and said valve plate having a pivoted end and a portion thereof deflectable to open the corresponding metering orifices under control of a suction pressure in a cylinder and to restore to a seated position closing the last-mentioned metering orifices when a given pressure exists in said mean pressure accumulating chambers.

6. A suction valve for use in a piston compressor for compressing a gaseous fluid according to claim 1, in which the volume of said mean pressure accumulating chamber and the metering orifice thereof are chosen so that a flow rate of a gaseous fluid through the last-mentioned metering orifice is effected to damp the movement of the valve plate in a direction toward said mean pressure accumulating chamber.

* * * * *